US007942450B2

(12) United States Patent
Kawano et al.

(10) Patent No.: US 7,942,450 B2
(45) Date of Patent: May 17, 2011

(54) SNOWBOARD

(75) Inventors: Hironobu Kawano, Tokyo (JP); Nobuhisa Saitoh, Tokyo (JP)

(73) Assignee: River Field Co., Ltd., Tokyo (JP)

( * ) Notice: Subject to any disclaimer, the term of this patent is extended or adjusted under 35 U.S.C. 154(b) by 103 days.

(21) Appl. No.: 12/298,833

(22) PCT Filed: Apr. 27, 2007

(86) PCT No.: PCT/JP2007/000475
§ 371 (c)(1),
(2), (4) Date: Oct. 28, 2008

(87) PCT Pub. No.: WO2007/125655
PCT Pub. Date: Nov. 8, 2007

(65) Prior Publication Data

US 2009/0066073 A1 Mar. 12, 2009

(30) Foreign Application Priority Data

Apr. 29, 2006 (JP) ..... 2006-127142

(51) Int. Cl.
*A63C 17/26* (2006.01)

(52) U.S. Cl. ..... 280/816

(58) Field of Classification Search ..... 280/809–816
See application file for complete search history.

(56) References Cited

U.S. PATENT DOCUMENTS

| | | | | |
|---|---|---|---|---|
| 6,802,636 | B1 * | 10/2004 | Bailey, Jr. | 362/555 |
| 7,232,243 | B1 * | 6/2007 | Nassif | 362/459 |
| 2005/0162844 | A1 * | 7/2005 | Yun-Ki | 362/34 |
| 2007/0194558 | A1 * | 8/2007 | Stone et al. | 280/601 |

FOREIGN PATENT DOCUMENTS

| | | | |
|---|---|---|---|
| JP | 63-193084 | U | 12/1988 |
| JP | 05-177027 | A | 7/1993 |
| JP | 6-66750 | U | 9/1994 |

(Continued)

OTHER PUBLICATIONS

International Search Report of PCT/JP2007/00075 with Mailing Date of May 29, 2007.

*Primary Examiner* — Jeffrey J Restifo
*Assistant Examiner* — Erez Gurari
(74) *Attorney, Agent, or Firm* — Westerman, Hattori, Daniels & Adrian, LLP

(57) ABSTRACT

There is provided a snowboard capable of drawing attention of a back sliding person more appropriately than the related art. A snowboard including: a board (20) having a sole member (21); LEDs (60 to 69) which are arranged between a snow contacting point (21*a*) of a nose (20*c*) side of the board (20) and a snow contacting point (21*b*) of a tail (20*d*) side of the board (20); a front foot binding fixed to the board (20) for fixing the front foot of a user; and a back foot binding fixed to the board (20) for fixing the back foot of the user, wherein the sole member (21) is translucent and covers the LEDs (60 to 69); and the LEDs (60 to 69) are arranged in positions to emit light to the outside of the board (20) through the sole member (21) and are arranged between the front foot binding and the back foot binding to indicate the length between the front foot binding and the back foot binding.

14 Claims, 10 Drawing Sheets

FOREIGN PATENT DOCUMENTS

| | | | |
|---|---|---|---|
| JP | 7-439 | U | 1/1995 |
| JP | 3029364 | U | 9/1996 |
| JP | 10-216296 | A | 8/1998 |
| JP | 2000-217949 | A | 8/2000 |
| JP | 3074861 | U | 11/2000 |
| JP | 2001-029532 | A | 2/2001 |
| JP | 2001-351416 | A | 12/2001 |
| JP | 2003-190356 | A | 7/2003 |
| JP | 2005-521493 | A | 7/2005 |
| JP | 2005-521494 | A | 7/2005 |

* cited by examiner

SNOWBOARD

FIELD OF THE INVENTION

The present invention relates to a snowboard used for sliding on snow.

DESCRIPTION OF THE RELATED ART

When visibility is poor in cases such as in a snowstorm, when fog rises, or when snowboarding at night, it is hard for a back person in sliding persons using snow sliding equipments (hereinafter, a "back sliding person") to notice a front person (hereinafter, a "front sliding person"). Therefore, when the sliding speed of the back sliding person is higher than that of the front sliding person, a collision between the front sliding person and the back sliding person can occur.

To avert such collision, it is considered to make the snow sliding equipment of the front sliding person luminous to draw attention of the back sliding person to the front sliding person.

There have been known, as the luminous snow sliding equipment, skis having a luminous surfaces by an incorporated LEDs (Light Emitting Diode) (see Patent Document 1), a snowboard having a lighting unit attached to its top or rear face or the like(see Patent Document 2), and a snowboard having a drawing pattern drawn on its front or rear face with luminous paint (see Patent Documents 3 and 4).

Patent Document 1: Japanese Patent Application Laid-Open (JP-A) No. 5-177027

Patent Document 2: Japanese Patent Application Laid-Open (JP-A) No. 2003-190356

Patent Document 3: Japanese Utility Model Registration (JP-U) No. 3029364

Patent Document 4: Japanese Patent Application Laid-Open (JP-A) No. 10-216296

DISCLOSURE OF THE INVENTION

Problem to be Solved by the Invention

However, when skis 211 described in Patent Document 1 are used by a front sliding person 210, light emitted from a top faces 211*a* may directly enter the eyes of the front sliding person 210 and a back sliding person 220 as illustrated in FIG. 10. Thus, there has been a problem that the skis 211 are not suitable for averting a collision between the front sliding person 210 and the back sliding person 220.

In a large ski slope with poor visibility or the like, the light has to be intense since the light emitted from the skis 211 is difficult to be identified by the back sliding person 220 if it is weak. If the back sliding person 220 directly sees the intense light emitted from the top faces 211*a* of the skis 211 of the front sliding person 210, the eyesight of the back sliding person 220 becomes temporality weak, then the back sliding person 220 cannot appropriately view the front sliding person 210. If the back sliding person 220 tries not to see the light emitted from the top faces 211*a* of the skis 211 of the front sliding person 210, naturally, the back sliding person 220 cannot appropriately view the front sliding person 210. When the back sliding person 220 cannot appropriately view the front sliding person 210, it is difficult for the back sliding person 220 to appropriately avert collision with the front sliding person 210.

Since the intense light emitted from the top faces 211*a* of the skis 211 of the front sliding person 210 also enters the eyes of the front sliding person 210, it is difficult for the front sliding person 210 to view his/her periphery due to the intense light emitted from the top faces 211*a* of the skis 211 used by himself/herself. When it is difficult for the front sliding person 210 to view his/her periphery, the front sliding person 210 may take an action, which cannot be expected by the back-sliding person 220. Therefore, it is further difficult for the back sliding person 220 to appropriately avert collision with the front sliding person 210.

In FIG. 10, outline arrows indicate the light emitted from the top faces 211*a* of the skis 211.

Since sliding on snow typically means sliding down a snow slope, the back sliding person mostly sees in the forward direction, that is, in the downward direction. Therefore, the back sliding person can hardly have an opportunity to view the rear face of the snow sliding equipment of the front sliding person. The snowboard described in Patent Document 2 has a lighting unit attached to the rear face and when the snowboard is used by the front sliding person, light emitted from the rear face does not directly enter the eyes of the back sliding person. Instead, the light is reflected on the snow surface to enter the eyes of the back sliding person. Therefore, the snowboard described in Patent Document 2 is more suitable for averting a collision between the front sliding person and the back sliding person than the skis described in Patent Document 1.

In the snowboard described in Patent Document 2, the lighting unit cannot be attached to a portion covered or uncovered by snow each time a user makes a turn, that is, a portion brought into contact with snow during sliding (hereinafter, a "snow contacting portion") since unevenness is caused in the snow contacting portion if the lighting unit is attached, which is troublesome in sliding. Accordingly, the lighting unit is attached to the front end or the back end of the snowboard. When the lighting unit is attached to the front end or the back end of the rear face of the snowboard, light emitted from the lighting unit and reflected on the snow surface is always viewed by the back sliding person. Therefore, the snowboard described in Patent Document 2 has a problem that the back sliding person gets used to the unchanged and monotone light and then the back sliding person cannot pay attention to the front sliding person.

In the snowboards described in Patent Documents 3 and 4, the luminous drawing pattern is provided onto the snow contacting portion covered or uncovered by snow each time a user makes a turn. However, the luminous paint causes the amount of light is small and thus the back sliding person cannot notice the light of the luminous paint reflected on the snow surface.

The present invention has been made to solve the problems of the related art and an object of the present invention is to provide a snowboard capable of drawing attention of the back sliding person more appropriately than the related art.

Means for Solving Problems

A snowboard of the present invention includes: a main body having a sole member; light emitting devices between snow contacting points which are arranged between a snow contacting point on the front side of the main body in the sliding direction and a snow contacting point on the back side in the sliding direction and emit light by electricity; a front foot binding fixed to the main body for fixing the front foot of a user; and a back foot binding fixed to the main body for fixing the back foot of the user, wherein the sole member is translucent and covers the light emitting devices between snow contacting points; and the light emitting devices between snow contacting points are arranged in positions to emit light to the outside of the main body through the sole member and are arranged between the front foot binding and the back foot binding to indicate the length between the front foot binding and the back foot binding.

With this configuration, the snowboard of the present invention is provided with the light emitting devices between snow contacting points, which causes a larger amount of light than that caused by the luminous paint, in the snow contacting portion covered or uncovered by snow each time the user makes a turn and thus the snowboard may more appropriately draw attention of the back sliding person by variable illumination than the related art. Since the light emitting devices between snow contacting points are covered by the sole member, the light emitting devices between snow contacting points may not be troublesome in sliding even though they are provided in the snow contacting portion. With the snowboard of the present invention, the back sliding person can identify the width of the body of the user according to the length between the front foot binding and the back foot binding so that the back sliding person can avert collision with the body of the user even when the back sliding person cannot directly view the body of the user due to a fog or the like.

In the snowboard of the present invention, the light emitting devices between snow contacting points are arranged on both of the left and right sides of the main body in the sliding direction.

With this configuration, in the snowboard of the present invention, illumination is alternately performed by the light emitting devices between snow contacting points arranged on the left side of the main body in the sliding direction and the light emitting devices between snow contacting points arranged on the right side of the main body in the sliding direction each time the user makes a turn. Therefore, this configuration can further draw attention of the back sliding person than a configuration in which the light emitting devices between snow contacting points are arranged on either of the left and right sides of the main body in the sliding direction.

In the snowboard of the present invention, the tip ends of the light emitting devices between snow contacting points are buried into the sole member.

With this configuration, in the snowboard of the present invention, the light emitting devices between snow contacting points can emit light also from the sides of their tip ends to the outside through the sole member. Therefore the light emission area by the light emitting devices between snow contacting points can be larger than that by a configuration in which the tip ends of the light emitting devices between snow contacting points are not buried into the sole member then it is possible to further draw attention of the back sliding person.

Effects of the Invention

According to the present invention, the snowboard capable of drawing attention of the back sliding person more appropriately than the related art can be provided.

DESCRIPTION OF REFERENCE NUMERALS

10 Snowboard
20 Board (main body)
21 Sole member
21*a* Snow contacting point (snow contacting point on the front side)
21*b* Snow contacting point (snow contacting point on the back side)
30 Binding (back foot binding)
30*a* Foot placing portion
40 Binding (front foot binding)
50 Deck pad
60 to 69 LED (light emitting device between snow contacting points)
100 Solar battery (power supply)
110 Charger (power supply)
120 Switch

BEST MODE FOR CARRYING OUT THE INVENTION

An embodiment of the present invention will be described below using the drawings.

First, a configuration of a snowboard according to this embodiment will be described.

Figure 1:
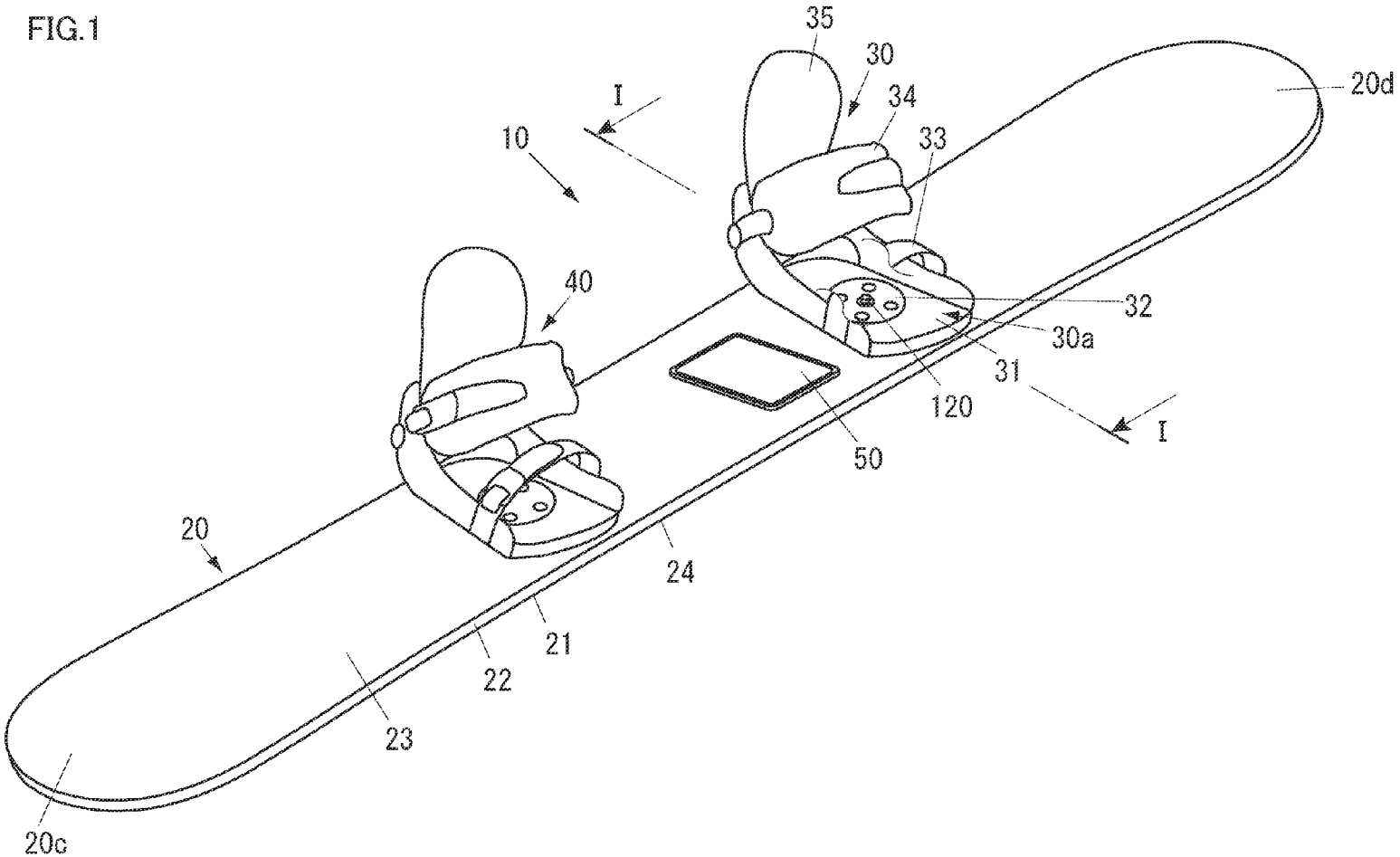
FIG. 1 is an appearance perspective view of a snowboard according to an embodiment of the present invention with a toe strap of a back foot binding partially broken away.

As illustrated in FIG. 1, a snowboard 10 according to this embodiment includes a board 20 as a main body; a back foot binding 30 that has a foot placing portion 30*a* for placing the boot of the back foot of a user thereon and is fixed to the board 20; a front foot binding 40 that is fixed to the board 20; and a deck pad 50, on which the boot of the back foot of the user removed from the binding 30.

Figure 2:
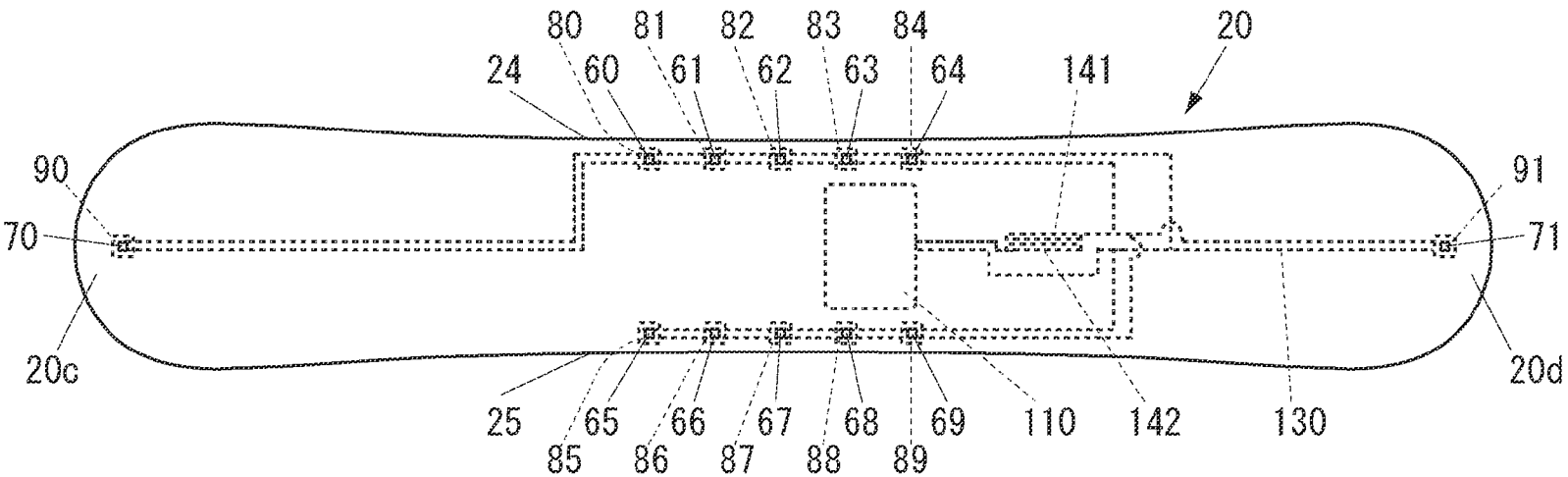
FIG. 2 is a bottom view of a board illustrated in FIG. 1 to show wiring in the board.

As illustrated in FIG. 2, the snowboard 10 also includes LEDs 60 to 71 that emit light by electricity; heat sinks 80 to 91 that are respectively attached to the LEDs 60 to 71 to prevent lowering the amount of light due to heat generation of the LEDs 60 to 71; a solar battery 100 (see FIG. 3) that generates electricity; a charger 110 that stores electricity generated by the solar battery 100; a switch 120 (see FIG. 1) that is arranged on the foot placing portion 30*a* (see FIG. 1) of the binding 30 (see FIG. 1) to switch the electric connection states of the LEDs 60 to 71 and the charger 110; an electric wire 130 that electrically connects the LEDs 60 to 71, the charger 110, and the switch 120; and electrodes 141 and 142 that are electrically connected to the electric wire 130, respectively. The solar battery 100 and the charger 110 compose a power supply.

The LEDs 60 to 71, the heat sinks 80 to 91, and the electric wire 130 may be incorporated inside the board 20 during the manufacturing process of the board 20 or may be incorporated inside the board 20 after the board 20 is manufactured by making holes on the board 20, for example.

Figure 4A:
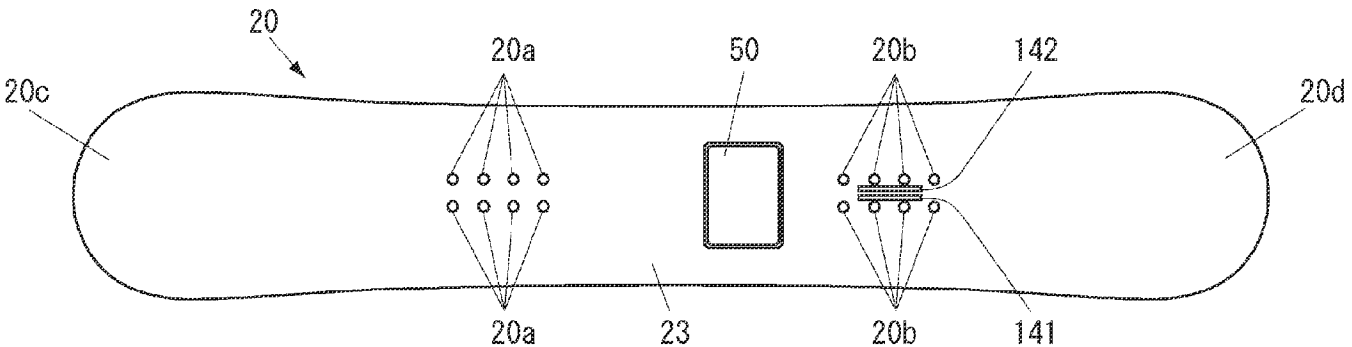
FIG. 4A is a top view of the board illustrated in FIG. 2.
Figure 4B:
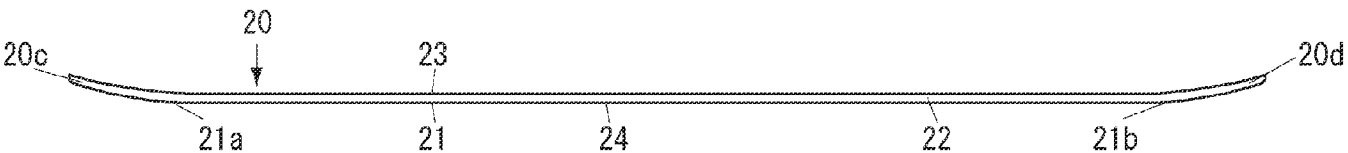
FIG. 4B is a side view of the board illustrated in FIG. 2.
Figure 4C:
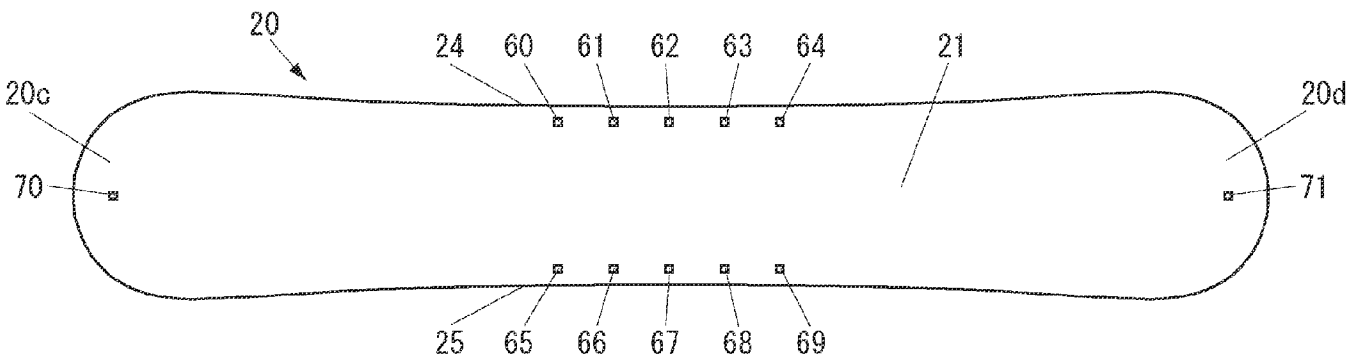
FIG. 4C is a bottom view of the board illustrated in FIG. 2.

As illustrated in FIG. 4, the board 20 has a sole member 21 that is translucent and milk white; a interlining member 22 laid onto the sole member 21; a deck member 23 overlapped onto the interlining member 22; a left edge 24 that is an edge on a side closer to toes of the boots fixed to the bindings 30 and 40 (see FIG. 1) that is a side on left in the sliding direction; and a right edge 25 that is an edge on a side closer to heels of the boots fixed to the bindings 30 and 40 that is a side on right in the sliding direction. Eight insert holes 20*a* for fixing the front foot binding 40 and eight insert holes 20*b* for fixing the back foot binding 30 are formed in the deck member 23. The electrodes 141 and 142 are provided on the deck member 23 extending in the same direction as the extending direction of the board 20.

As illustrated in FIG. 1, the binding 30 includes a base plate 31; a center disk 32 for adjusting an angle of the base plate 31 with respect to the board 20 and fixing the base plate 31 to the board 20; a toe strap 33 for fixing the toe portion of the boot of the user; an ankle strap 34 for fixing the ankle portion of the boot of the user; and a high back 35 for fixing the back side of the boot of the user. The base plate 31 and the center disk 32 compose the foot placing portion 30*a*. The center disk 32 is fixed by screws, not illustrated, inserted into the insert holes 20*b* (see FIG. 4A) of the board 20. The binding 40 has the similar configuration and the configuration is not described here.

Figure 3A:
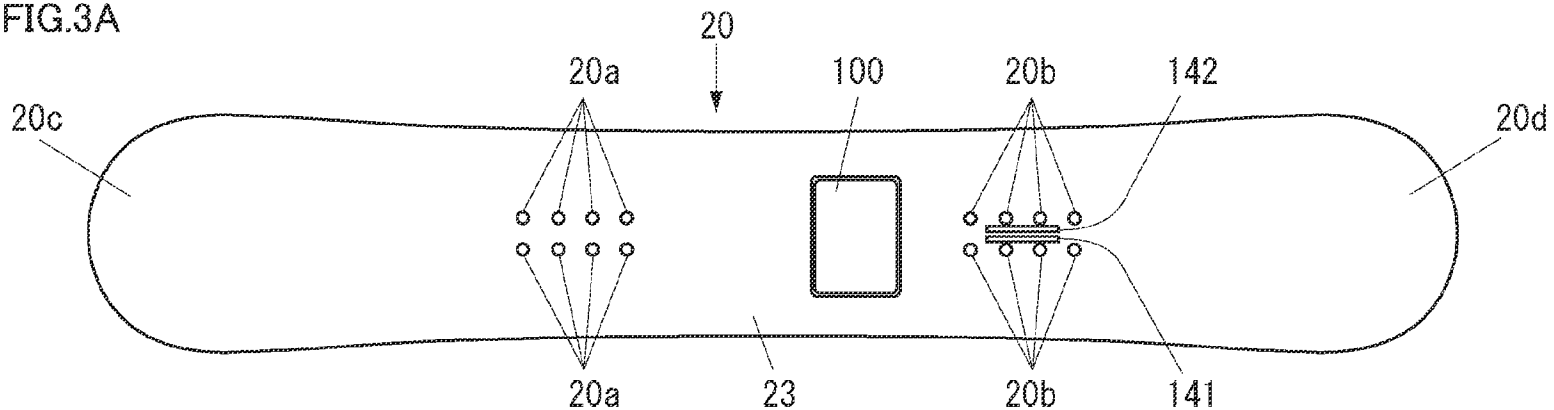
FIG. 3A is a top view of the board illustrated in FIG. 2 in a state with a deck pad detached.
Figure 3B:
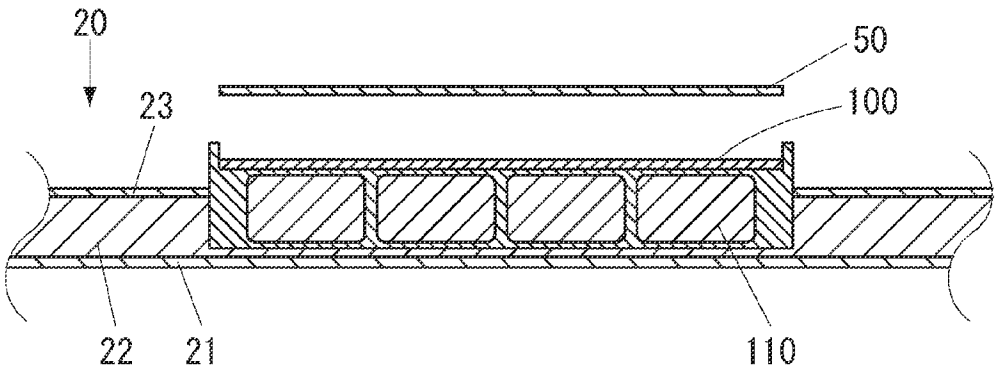
FIG. 3B is a side sectional view of the board illustrated in FIG. 2 with the deck pad detached.

As illustrated in FIG. 3B, the deck pad 50 is detachable from the board 20 in a position covering the solar battery 100. The deck pad 50 is attached to the solar battery 100 by an adhesive that is removable or the like so as not to fall out of the board 20 in typical sliding.

Figure 5:
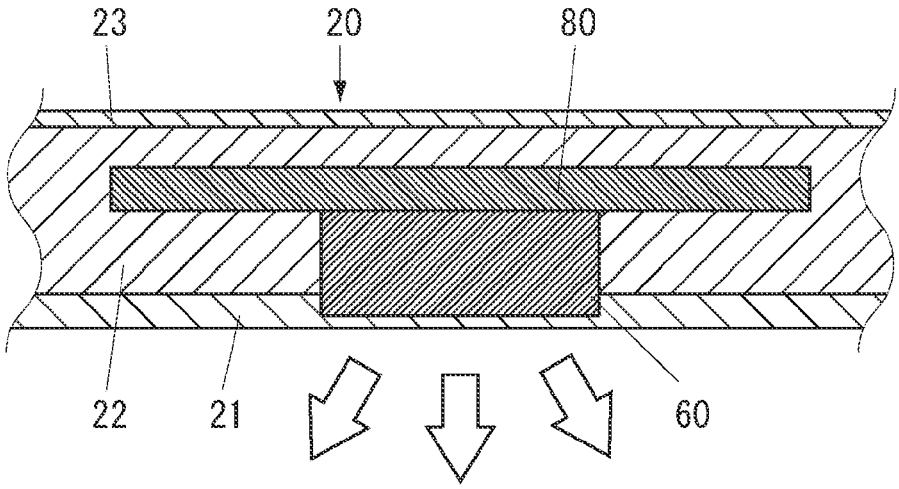
FIG. 5 is a partially sectional view of the board illustrated in FIG. 2 to show the vicinity of a LED.

As illustrated in FIG. 4, the LEDs 60 to 69 are arranged between a snow contacting point 21*a* on a nose 20*c* side that is the front side of the board 20 in the sliding direction and a snow contacting point 21*b* on a tail 20*d* side that is the back side in the sliding direction, in other words, in the snow contacting portion. The LEDs 60 to 69 compose a light emitting device between snow contacting points. The LEDs 60 to 64 are arranged along the left edge 24 on the left side of the board 20 in the sliding direction. The LEDs 65 to 69 are arranged along the right edge 25 on the right side of the board 20 in the sliding direction. The LED 70 is arranged in the nose 20*c* of the board 20. The LED 71 is arranged in the tail 20*d* of the board 20. As illustrated in FIG. 5, the LEDs 60 to 71 are incorporated into the board 20 in a manner that their tip ends are buried into the sole member 21 and covered by the sole member 21 and the LEDs 60 to 71 are arranged in positions capable of emitting light to the outside of the board 20 through the sole member 21. In FIG. 5, outline arrows indicate the light emitted by the LED 60.

As illustrated in FIG. 3, the solar battery 100 is provided in a position, to which the deck pad 50 is attached. The charger 110 is arranged on a side, which is closer to the sole member 21, of the solar battery 100 while electrically connected to the solar battery 100 and is buried into the board 20.

Figure 6A:
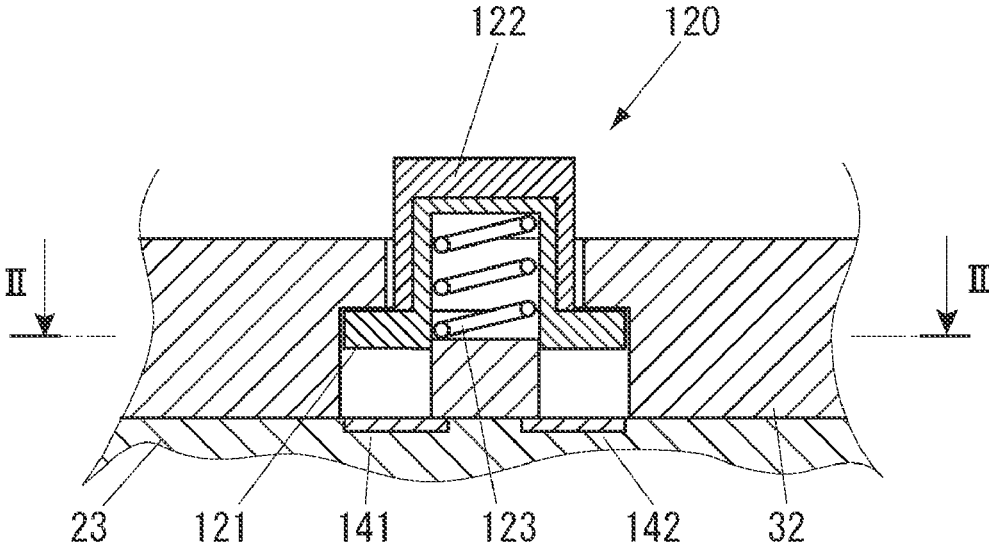
FIG. 6A is a cross-sectional view taken along with a line I-I of FIG. 1 and seen in the direction of the arrows I-I in the state that the boot of a user is not placed on a foot placing portion of the back foot binding.
Figure 6B:
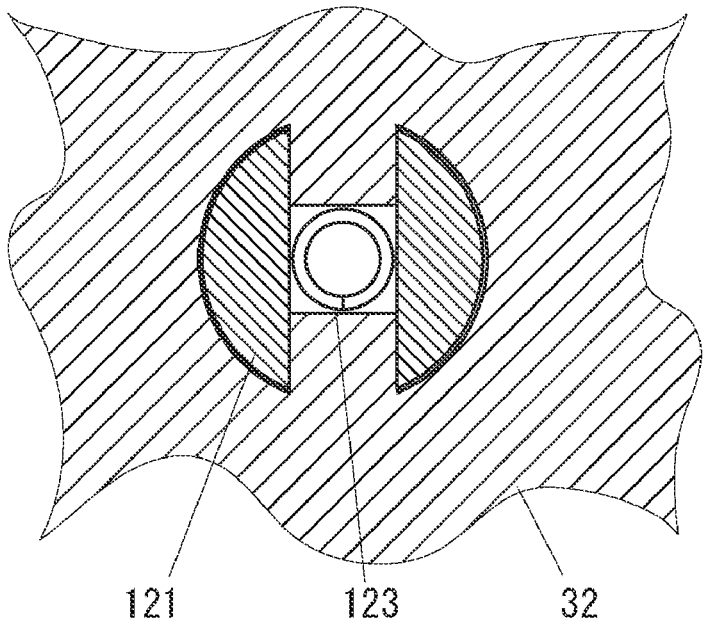
FIG. 6B is a cross-sectional view taken along with a line II-II of FIG. 6A and seen in the direction of the arrows II-II.

As illustrated in FIG. 6, the switch 120 is provided on the center disk 32 of the binding 30 (see FIG. 1) in a manner that the switch 120 disconnects the electric connection between the LEDs 60 to 71 (see FIG. 2) and the charger 110 (see FIG. 2) when it is not pressed. The switch 120 includes a connecting portion 121 which is made of metal and is for electrically connecting the electrodes 141 and 142 by contacting with the electrodes 141 and 142 provided on the deck member 23 at the same time; an operated portion 122 which is made of plastic, covers the connecting portion 121, and has a portion protruded outside of the center disk 32; and a spring 123 which biases the connecting portion 121 to the operated portion 122.

Next, the operation of the snowboard 10 will be described.

In the snowboard 10, the solar battery 100 generates electricity when it is illuminated with sunlight or the like while the deck pad 50 is detached and the generated electricity is stored in the charger 110.

Figure 7:
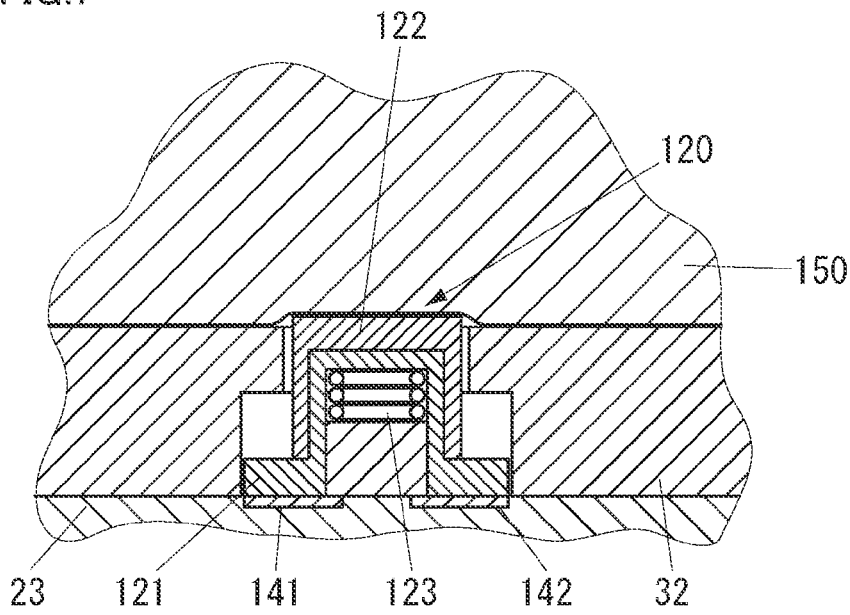
FIG. 7 is a cross-sectional view taken along with a line I-I of FIG. 1 and seen in the direction of the arrows I-I in the state that the boot of the user is placed on the foot placing portion of the back foot binding.

When the user places the back foot boot on the foot placing portion 30*a* of the back foot binding 30 for fixing the back foot boot before sliding, in the snowboard 10, the operated portion 122 of the switch 120 is pressed by a boot 150 as illustrated in FIG. 7 and then moved toward the electrodes 141 and 142 together with the connecting portion 121 against the bias of the spring 123. When the connecting portion 121 is brought into contact with the electrodes 141 and 142, the electric circuit between the charger 110 and the LEDs 60 to 71 is closed to supply the electricity from the charger 110 to the LEDs 60 to 71. When the electricity is supplied, the LEDs 60 to 71 emit light to the outside of the board 20 through the sole member 21. Therefore, the light emitted from the LEDs 60 to 71 to the outside of the board 20 is reflected on the snow surface or the like and is then viewed by the back sliding person.

Figure 8A:
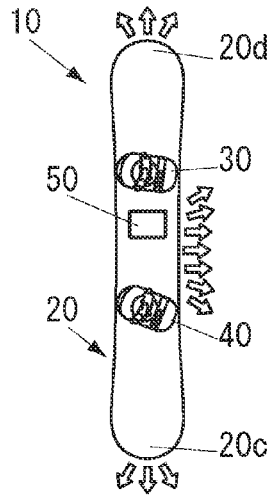
FIG. 8A is a top view of the board illustrated in FIG. 2 to show the state of illumination of the LEDs when the user is performing sliding with it standing at the right edge.
Figure 8B:
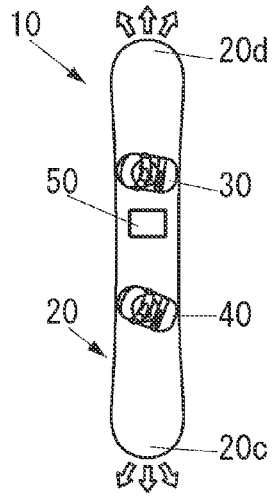
FIG. 8B is a top view of the board illustrated in FIG. 2 to show the state of illumination of the LEDs when the user is performing sliding with it not standing at either edge.
Figure 8C:
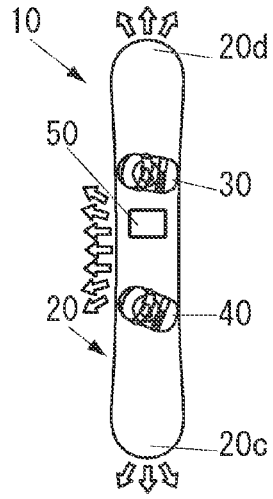
FIG. 8C is a top view of the board illustrated in FIG. 2 to show the state of illumination of the LEDs when the user is performing sliding with it standing at the left edge.
Figure 9A:
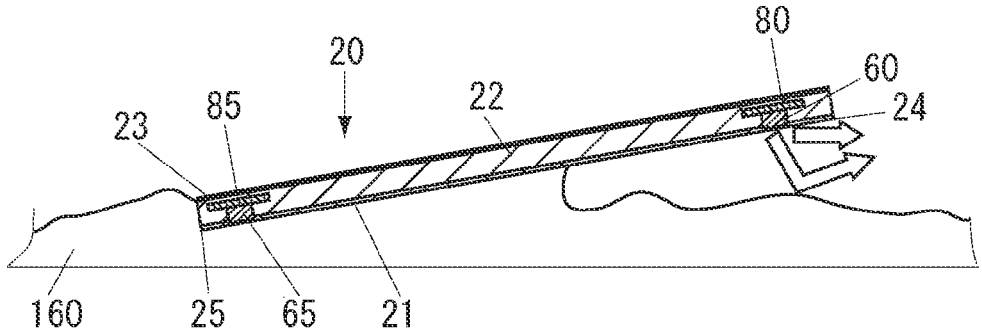
FIG. 9A is a front sectional view of the board illustrated in FIG. 2 to show the state of illumination of the LEDs when the user is performing sliding with it standing at the right edge.
Figure 9B:
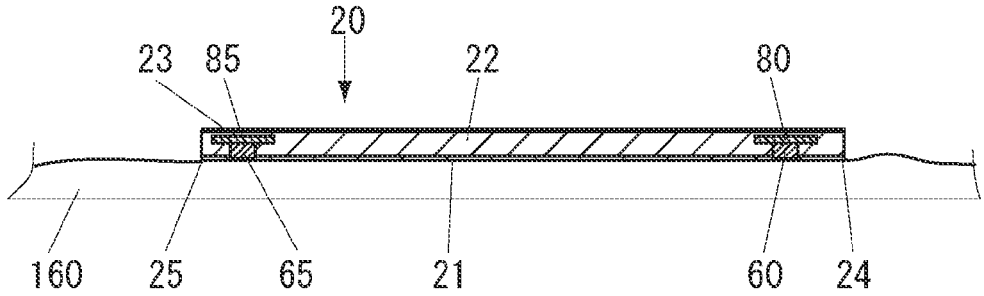
FIG. 9B is a front sectional view of the board illustrated in FIG. 2 to show the state of illumination of the LEDs when the user is performing sliding with it not standing at either edge.
Figure 9C:
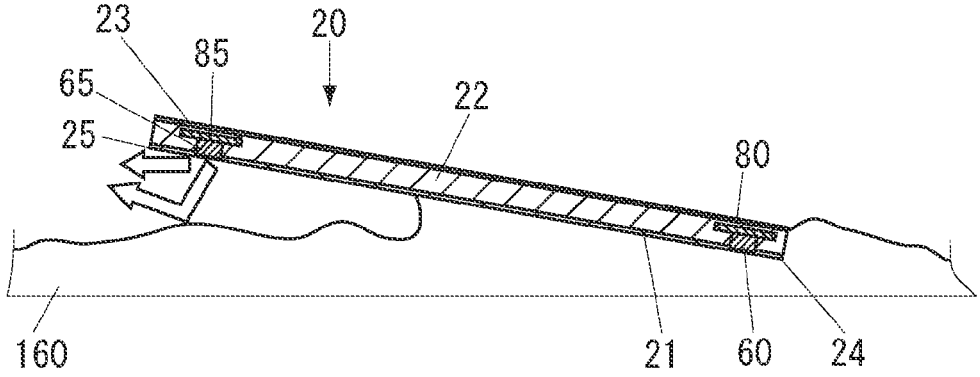
FIG. 9C is a front sectional view of the board illustrated in FIG. 2 to show the state of illumination of the LEDs when the user is performing sliding with it standing at the left edge.
Figure 10:
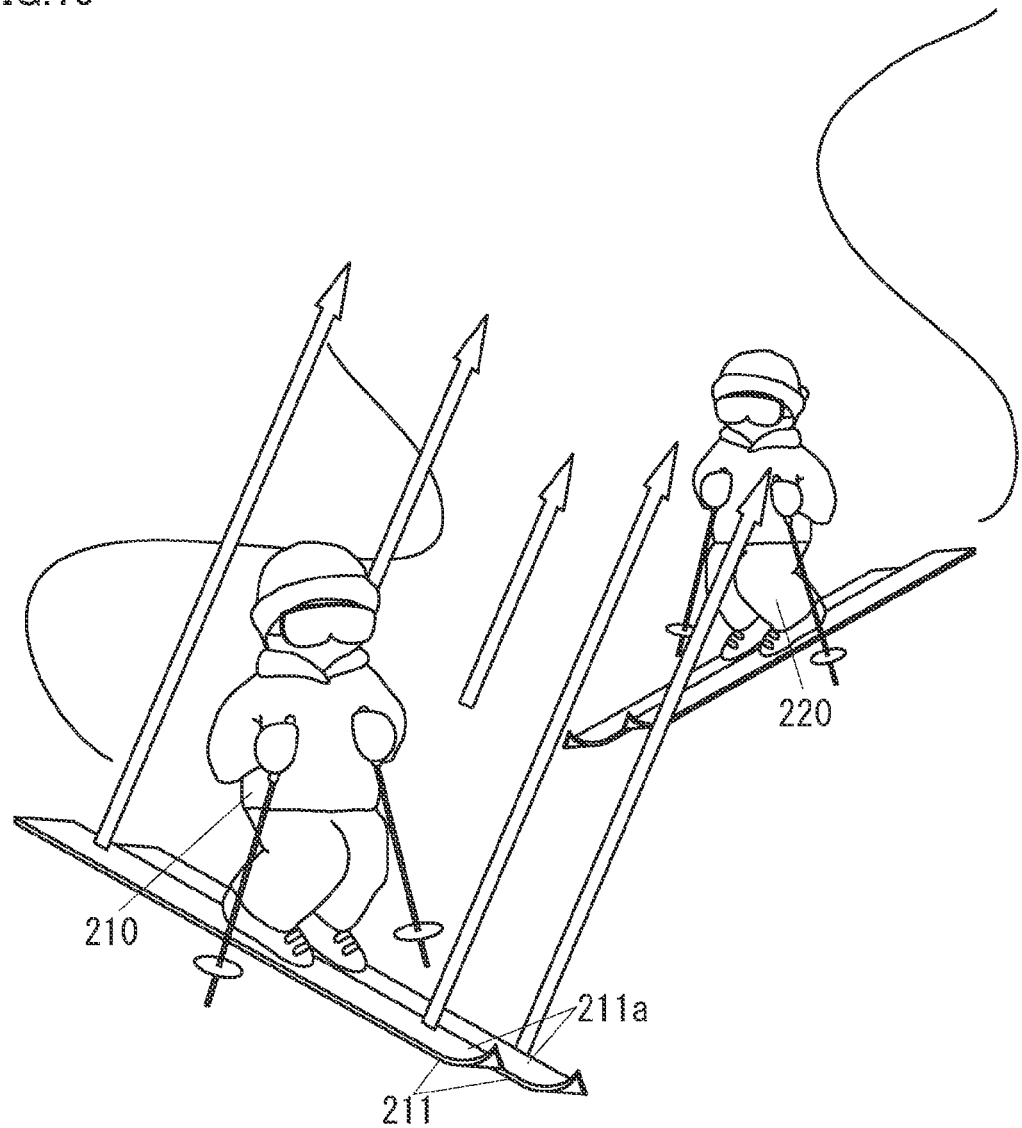
FIG. 10 is a diagram to show a snow sliding equipment of the related art in usage state.

While the user slides down a snow slope the snowboard 10 always illuminates by the LED 70 (see FIG. 4C) arranged in the nose 20*c* of the board 20 and the LED 71 (see FIG. 4C) arranged in the tail 20*d* of the board 20 as illustrated in FIG. 8. When the user stands the snowboard 10 at the right edge 25, the LEDs 65 to 69 (see FIG. 4C) arranged on the right side of the board 20 in the sliding direction are hidden in snow 160 and thus illumination is not performed by the LEDs 65 to 69 but performed by the LEDs 60 to 64 (see FIG. 4C) arranged on the left side of the board 20 in the sliding direction as illustrated in FIGS. 8A and 9A. When the user does not stand the snowboard 10 either at the left edge 24 or the right edge 25, the LEDs 60 to 69 (see FIG. 4C) are hidden in the snow 160 and thus illumination is not performed by the LEDs 60 to 69 as illustrated in FIGS. 8B and 9B. When the user stands the snowboard 10 at the left edge 24, the LEDs 60 to 64 (see FIG. 4C) are hidden in the snow 160 and thus illumination is not performed by the LEDs 60 to 64 but performed by the LEDs 65 to 69 (see FIG. 4C) as illustrated in FIGS. 8C and 9C. In other words, the snowboard 10 changes illumination by the LEDs 60 to 69 each time the user makes a turn. In FIGS. 8 and 9, outline arrows indicate the light emitted by the LEDs 60 to 71.

When the user removes the back foot boot from the binding 30 to sit on a lift, for example, in the snowboard 10, the connecting portion 121 is moved away from the electrodes 141 and 142 as illustrated in FIG. 6 due to the bias of the spring 123 to open the electric circuit between the charger 110 and the LEDs 60 to 71. Therefore electricity supply to the LEDs 60 to 71 is stopped, then the LEDs 60 to 71 stop light emission.

The snowboard 10 with the deck pad 50 attached thereon allows the user to slide with the back foot boot placed on the deck pad 50.

As described above, the snowboard 10 is provided with the LEDs 60 to 69, which causes a larger amount of light than that caused by the luminance paint, in the snow contacting portion covered or uncovered by snow each time the user makes a turn and thus the snowboard 10 may more appropriately draw attention of the back sliding person by variable illumination than the related art. Therefore, the snowboard 10 may make the back sliding person to notice the user to avert a collision, for example.

The snowboard 10 is provided with the LEDs 60 to 69, which causes a larger amount of light larger than that caused by the luminance paint, in the snow contacting portion covered or uncovered by snow each time the user makes a turn and thus the snowboard 10 may better attract public attention by variable illumination than the related art. Therefore, the snowboard 10 may better show performance in a night exhibition, for example.

Since the LEDs 60 to 69 are covered by the sole member 21, the LEDs 60 to 69 may not be troublesome in sliding even though they are provided in the snow contacting portion.

Since the snowboard 10 is provided with the LEDs 60 to 71 in the snow contacting portion, it is possible to prevent the LEDs 60 to 71 from affecting the design of the deck.

The snowboard 10 is configured in such a manner that the LEDs 60 to 71 are constantly lit when the electric circuit is closed by the switch 120. However, more variable illumination can be realized by configuring the LEDs 60 to 71 to emit light in a predetermined flashing pattern.

In the snowboard 10, illumination is alternately performed by the LEDs 60 to 64 arranged on the left side of the board 20 in the sliding direction and the LEDs 65 to 69 arranged on the right side of the board 20 in the sliding direction each time the user makes a turn. Therefore, the snowboard 10 can further draw attention of the back sliding person than a configuration in which the LEDs are arranged on either of the left and right sides of the board 20 in the sliding direction. The snowboard 10 may be provided with the LEDs on either of the left and right sides of the board 20 in the sliding direction.

In the snowboard 10, the tip ends of the LEDs 60 to 71 are buried into the sole member 21 and thus the LEDs 60 to 71 can emit light also from the sides of their tip ends to the outside of the snowboard 10 through the sole member 21. Therefore the light emission area by the LEDs 60 to 71 can be larger than that by a configuration in which the tip ends of the LEDs 60 to 71 are not buried into the sole member 21, then it is possible to further draw attention of the back sliding person.

Since the tip ends of the LEDs 60 to 71 are buried into the sole member 21 in the snowboard 10, the distance from the tip ends of the LEDs 60 to 71 to the outside of the snowboard 10 is shorter than that of a configuration in which the tip ends of the LEDs 60 to 71 are not buried into the sole member 21. In other words, the thickness of the sole member 21 through which the light emitted from the LEDs 60 to 71 pass is smaller than that of a configuration in which the tip ends of the LEDs 60 to 71 are not buried into the sole member 21. Therefore, the intensity of the light emitted from the LEDs 60 to 71 to the outside of the snowboard 10 can be increased and can further draw attention of the back sliding person.

In the snowboard 10, the ends of the LEDs 60 to 71 may not be buried into the sole member 21.

In the snowboard 10, the LEDs 60 to 69 are arranged between the back foot binding 30 and the front foot binding 40 to indicate the length between the binding 30 and the binding 40. Therefore, the back sliding person can identify the width of the body of the user according to the length between the binding 30 and the binding 40 so that the back sliding person can avert collision with the body of the user even when the back sliding person cannot directly view the body of the user due to a fog or the like.

The switch 120 is provided on the foot placing portion 30*a* of the binding 30 in the snowboard 10. Thus, when the user removes the foot from the binding 30, for example when the user is not sliding, no electricity is supplied to the LEDs 60 to 71. Therefore the power consumption can be reduced. When the user is not sliding down the snow slope, for example, when the user sits on the lift, in the snowboard 10, the back foot of the user is removed from the binding 30. Therefore, especially in the snowboard 10, the power consumption can be reduced more effectively comparing to the ski, in which the foot of the user does not removed from the binding when the user sits on the lift. In the snowboard 10, the space for providing the power supply is limited and thus it is difficult to provide a large size power supply of high capacity. Therefore, it is very preferable for the snowboard 10 to reduce power consumption.

The switch 120 switches the electric connection states of the LEDs 60 to 71 and the charger 110 provided in the snowboard 10, however, the electric connection states that the switch 120 switches is not limited to that of the LEDs with the charger and the switch 120 may configured to switch electric connection states of various devices provided in the snowboard 10 with the charger 110. For example, in the case that a heat generating device for making the board 20 irradiate heat is provided in order to reduce the friction resistance of the snowboard 10 with the snow surface to increase the sliding speed, the switch 120 may be configured to switch the electric connection states of the heat generating device and the charger 110.

In the snowboard 10, the switch 120 is provided on the center disk 32 of the binding 30. The switch 120 may be provided in any position as long as it is pressed by the boot placed by the user and thus it may be provided on the base plate 31. In the snowboard 10, since the switch 120 is provided on the foot placing portion 30*a* of the binding 30 in the snowboard 10, the switch 120 can be prevented from affecting the design of the deck. The snowboard 10 may have another switch in place of the switch 120. The snowboard 10 may have a toggle switch on the deck member 23 in place of the switch 120, for example. The snowboard 10 may have a switch switched according to an infrared ray emitted from a portable terminal such as a cellular phone in place of the switch 120.

The snowboard 10 may not be provided with a switch so as to constantly supply electricity from the charger 110 to the LEDs 60 to 71.

The snowboard 10 is provided with the deck pad 50 detachable from the board 20 in a position covering the solar battery 100. Therefore, the solar battery 100 can be prevented from affecting the design of the deck. In the snowboard 10, the solar battery 100 may be arranged in a position different from the attaching position on the deck pad 50.

The snowboard 10 has the solar battery 100 and the charger 110 as a power supply, however, it may have a power supply other than the solar battery 100 and the charger 110. The snowboard 10 may have a dry-cell battery in place of the solar battery 100 and the charger 110 or a piezoelectric device for generating electricity by vibration received by the board 20 in place of the solar battery 100, for example.

What is claimed is:

1. A snowboard comprising:

a main body having a sole member;

light emitting devices between snow contacting points which are arranged between a snow contacting point on the front side of the main body in the sliding direction and a snow contacting point on the back side in the sliding direction and emit light by electricity;

a front foot binding fixed to the main body for fixing the front foot of a user; and a back foot binding fixed to the main body for fixing the back foot of the user, wherein the sole member is translucent and covers the light emitting devices between snow contacting points; and the light emitting devices between snow contacting points are arranged in positions to emit light to the outside of the main body through the sole member and are arranged only between the front foot binding and the back foot binding to indicate the length between the front foot binding and the back foot binding.

2. The snowboard according to claim 1, wherein the light emitting devices between snow contacting points are arranged on both of the left and right sides of the main body in the sliding direction.

3. The snowboard according to claim 1, wherein the tip ends of the light emitting devices between snow contacting points are buried into the sole member.

4. The snowboard comprising according to claim 1, further comprising:

an electrical power supply; and a switch, wherein the light emitting devices communicate via a switch with the electrical power supply.

5. The snowboard according to claim 1, wherein the main body comprises:

an interlining member disposed on a top surface of the sole member; and a deck member disposed on a top surface of the interlining member.

6. The snowboard according to claim 4, wherein the switch connects an electric connection between the light emitting devices and a charger when the switch is on.

7. The snowboard according to claim 6, wherein the switch is provided inside at least one of said front foot binding and rear foot binding and is activated when a user of said snowboard places a foot inside the binding provided with the switch.

8. The snowboard according to claim 6, wherein the switch is a toggle switch provided on an outside surface of the main body.

9. The snowboard according to claim 4, wherein the power supply comprises a solar battery and a charger.

10. The snowboard according to claim 1, further comprising heat sinks respectively attached to the light emitting devices.

11. The snowboard according to claim 9, further comprising:

a deck pad, wherein the deck pad is detachable from the main body in a position covering the solar battery, and the deck pad is attached to the solar battery and covers the upper surface of the solar battery.

12. The snowboard according to claim 1, further comprising:

a front light emitting device arranged in a nose portion of the main body in the sliding direction; and a back light emitting device arranged in a tail portion of the main body in the sliding direction, wherein the nose portion is arranged between the nose of the main body and the snow contacting point on the front side of the main body in the sliding direction, and the tail portion is arranged between the tail of the main body and the snow contacting point on the rear side of the main body in the sliding direction.

13. The snowboard according to claim 12, wherein the front and rear light emitting devices always illuminate light when the switch is on.

14. The snowboard according to claim 12, wherein a tip end of each of the front and back light emitting devices is buried into the sole member and covered by the sole member.

* * * * *